US011135129B2

(12) United States Patent
Greco

(10) Patent No.: US 11,135,129 B2
(45) Date of Patent: Oct. 5, 2021

(54) MASSAGE AND DILATING DEVICE

(71) Applicant: Darren J. Greco, Wellington, FL (US)

(72) Inventor: Darren J. Greco, Wellington, FL (US)

( * ) Notice: Subject to any disclaimer, the term of this patent is extended or adjusted under 35 U.S.C. 154(b) by 323 days.

(21) Appl. No.: 16/304,357

(22) PCT Filed: May 27, 2017

(86) PCT No.: PCT/US2017/034879
§ 371 (c)(1),
(2) Date: Nov. 26, 2018

(87) PCT Pub. No.: WO2017/205860
PCT Pub. Date: Nov. 30, 2017

(65) Prior Publication Data

US 2019/0290536 A1 Sep. 26, 2019

Related U.S. Application Data

(60) Provisional application No. 62/342,451, filed on May 27, 2016, provisional application No. 62/448,006, filed on Jan. 19, 2017.

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 23/0254* (2013.01);
(Continued)

(58) Field of Classification Search
CPC ..... A61H 19/00; A61H 19/40; A61H 19/44; A61H 23/02; A61H 23/0254; A61H 1/008;
(Continued)

(56) References Cited

U.S. PATENT DOCUMENTS 9,066,843 B1 6/2015 Greco
9,400,555 B2 * 7/2016 Quigley ..... A61H 19/44
(Continued)

FOREIGN PATENT DOCUMENTS

WO 2016/033640 A1 3/2016

OTHER PUBLICATIONS

International Search Report and Written Opinion for PCT/US17/34879 dated Aug. 15, 2017.
(Continued)

*Primary Examiner* — Valerie L Woodward
*Assistant Examiner* — Paige Kathleen Bugg
(74) *Attorney, Agent, or Firm* — Fleit Intellectual Property Law; Paul D. Bianco; Gary S. Winer

(57) ABSTRACT

A massage and dilating device is provided that includes a mechanical assembly and a control and drive assembly coupled to the mechanical assembly to control operation of the device. The mechanical assembly includes a hollow, cylindrical housing having a tapered end and a guide slot extending along an outer surface thereof, an elongated drive shaft positioned inside of the housing and having threads cut into the surface thereof, an inner shuttle engaging the threads on the drive shaft via an interposing pawl and positioned inside the housing, an outer shuttle positioned outside of the housing and coupled to the inner shuttle through the guide slot. The mechanical assembly may also include a flexible outer cover. The mechanical assembly may also include intermediate movable surfaces in lieu of the outer shuttle positioned between the outer surface of the housing and flexible covering engaged by the inner shuttle but not coupled thereto. The mechanical assembly housing may also be in the form of a bent cylindrical shape including an additional rigid shaft and flexible coupling or flexible shaft positioned therein. The control and drive assembly may
(Continued)

include an elongated flexible conduit or arm between said assembly and the mechanical assembly end.

18 Claims, 18 Drawing Sheets

(52) U.S. Cl.
CPC ..... *A61H 2201/0107* (2013.01); *A61H 2201/0176* (2013.01); *A61H 2201/123* (2013.01); *A61H 2201/5015* (2013.01); *A61H 2201/5023* (2013.01); *A61H 2201/5058* (2013.01); *A61H 2201/5064* (2013.01); *A61H 2201/5097* (2013.01)

(58) Field of Classification Search
CPC ..... A61H 39/007; A61H 2201/0107; A61H 2201/0153; A61H 2201/0157; A61H 2201/12–1215; A61H 2201/123; A61H 2205/087
USPC ..... 601/46
See application file for complete search history.

(56) References Cited

U.S. PATENT DOCUMENTS

| | | | | |
|---|---|---|---|---|
| 2007/0043388 | A1 | 2/2007 | Greenwood | |
| 2008/0091128 | A1* | 4/2008 | Nan | A61H 7/001 601/70 |
| 2008/0119767 | A1* | 5/2008 | Berry | A61H 19/34 601/46 |
| 2009/0099413 | A1* | 4/2009 | Kobashikawa | A61H 19/40 600/38 |
| 2009/0118759 | A1 | 5/2009 | Eidenschink | |
| 2014/0357944 | A1* | 12/2014 | Spietz | A61H 19/40 600/38 |
| 2016/0120737 | A1* | 5/2016 | Sedic | A61H 19/34 601/46 |
| 2017/0239134 | A1* | 8/2017 | Rossi | A61H 19/44 |

OTHER PUBLICATIONS

International Preliminary Search Report and Written Opinion for PCT/US17/34879 dated Dec. 6, 2018.

* cited by examiner

MASSAGE AND DILATING DEVICE

FIELD OF THE INVENTION

The invention is directed to devices for massage, dilation or penetration of the body, such as the vagina, and for use in pelvic floor exercise and therapy and sexual enhancement and stimulation.

BACKGROUND

Vaginal dilators have been used for many years in medicine for a wide variety of applications including oncology, radiotherapy, gynecology, obstetrics and sex therapy. Vaginismus is a gynecological condition involving involuntary contraction of the muscles surrounding the entrance to the vagina, making penetration impossible and/or painful. Vaginal agenesis is a birth defect or congenital disorder where sufferers have a short vagina (neo-vagina) or no vagina at all.

Treatment of these conditions may involve surgery followed by a period of vaginal training using dilators. Even in cases where surgery is not needed, medical dilators are used. There is also much post-operative need for massage treatment. For example, vaginal or anal prolapse surgery treats a condition where parts of the bladder, uterus, and/or rectum protrude from the vagina or anus. This type of surgery is commonly followed up with dilation or massage treatment.

For all of these conditions, dilation and/or massage is a significant part of the treatment procedure and is likely to remain important for the remainder of the patient's life. In use, these dilators and massagers are typically inserted into the affected cavity or orafice for sessions of varying length. Duration and frequency determined by individual need and response, and the particular area of the body requiring such treatment.

There are dilators of various design on the market. However, none of the designs currently provide an effective treatment of a cavity or orifice and the ability to manipulate various features of the device without having to switch out parts and/or manipulate the device while it has already been inserted into the orifice desired for treatment. Currently, dilator kits may be found on the market, which consist of a series of dilators of increasing length and diameter used in order to gradually expand the orifice. This type of product is undesirable because it comes with multiple parts which must be manipulated by the user.

For example, US 2007/0043388 discloses a kit comprising a series of dilators which are color coded because the difference in diameter from one dilator to the next may be small and hence not readily determined by sight or feel. This makes usage by the patient difficult, confusing and time consuming. Additionally, the user must choose which size of dilator to use and may not necessarily encourage stepping up to a larger size diameter even though the patient has grown accustomed to the smaller size, thus hindering progress of treatment. Furthermore, when these dilators are inserted into the vagina or other affected orafice, there is no expansion or retraction movement of the device needed to encourage the desired therapeutic response.

Balloon dilators are also sold in the market, however these types of dilators are associated with many drawbacks. For example, because of their inflatable nature, these products are not able to achieve a true uniformity of diameter along the length of the device. Any expansion or retraction provided by these types of devices is not easy to control by the user. Also, these types of dilators may be affected adversely by heat and therefore do not encourage optimized conditions for the patient who may desire or require a heated device for insertion into the orifice to be treated.

There is therefore a need for a dilator/massager device which incorporates a variety of different sizes of diameters in a single device which can be uniformly expanded and contracted along the length of the device, according to the patient's preferences or medical practioners' recommendations. A device that provides additional functions, such as penetration and assistance with pelvic floor exercises, pressure and trigger point activation, and sexual stimulation are also desired. Furthermore, there is a need for a single device with a variety of interchangeable attachments, rather than several independent single purpose devices, with each attachment providing a variable size and effect while installed and in use.

SUMMARY OF THE INVENTION

Accordingly, the present invention provides a massage, dilation and penetration device that is easy to use, incorporates a variety of different size, motion and therapy options for a single device by way of various attachments, and improves various pelvic and sexual dysfunction conditions.

The invention is directed to a massage and dilating device that includes a mechanical assembly and a control and drive assembly coupled to the mechanical assembly to control operation of the massage and dilating device. The mechanical assembly has a hollow, cylindrical housing having a tapered end and a guide slot extending along an outer surface thereof, an elongated drive shaft positioned inside of the housing and having channels or threads cut into or recessed in the surface thereof, one or more inner shuttles engaging the threads in the drive shaft by way of an intermediate pawl or leader and positioned inside the housing, and one or more outer shuttles positioned outside of the housing and coupled to the inner shuttle through the guide slot. Some mechanical assemblies may include one or more intermediate surfaces acted upon but uncoupled from the inner shuttles that may supplant the outer moveable shuttles. The drive shaft can be an elongated self-reversing or diamond pattern drive shaft. Mechanical assemblies may feature a curve or bend in the housing to better accommodate certain needs. In these assemblies, a flexible shaft or flexible coupling is attached between the drive shaft that engages the inner shuttles and the shaft or attachment point that is connected to the drive mechanism. This allows for the change of rotational axis due to the bend in the housing.

The invention also provides a massage and dilating device that includes a control handle and a mechanical assembly coupled to the control handle. The mechanical assembly includes a housing, an elongated drive shaft positioned inside of the housing and having channels or threads cut into or recessed in the surface thereof, one or more inner shuttles engaging the threads in the drive shaft by way of a pawl or leader and positioned inside the housing, and one or more outer shuttles positioned outside of the housing and coupled to the inner shuttle through the guide slot. Some mechanical assemblies may include one or more intermediate surfaces acted upon but uncoupled from the inner shuttles that may supplant the outer moveable shuttles. The drive shaft can be an elongated self-reversing or diamond pattern drive shaft. Mechanical assemblies may feature a curve or bend in the housing to better accommodate certain needs. In these assemblies, a flexible shaft or flexible coupling is attached between the drive shaft that engages the inner shuttles and the shaft or attachment point that is connected to the drive mechanism. This allows for the change of rotational axis due to the bend in the housing.

Another aspect of the invention relates to the embodiment above, whereby the device includes an elongated, flexible neck extending between and connecting the control handle to the mechanical assembly.

Another aspect of the invention relates to a massage and dilating device that includes a mechanical assembly and a control and drive assembly coupled to the mechanical assembly to control operation of the massage and dilating device. The mechanical assembly has a hollow, cylindrical housing having a tapered end and a guide slot extending along an outer surface thereof, an elongated drive shaft positioned inside of the housing and having channels or threads cut into or recessed in the surface thereof, one or more inner shuttles engaging the threads in the drive shaft by way of an intermediate pawl or leader and positioned inside the housing, and one or more outer shuttles positioned outside of the housing and coupled to the inner shuttle through the guide slot. Some mechanical assemblies may include one or more intermediate surfaces acted upon but uncoupled from the inner shuttles that may supplant the outer moveable shuttles. The drive shaft can be a jack screw or leader screw design with the housing removably coupled to the control and drive assembly via a modular connector. Mechanical assemblies may feature a curve or bend in the housing to better accommodate certain needs. In these assemblies, a flexible shaft or flexible coupling is attached between the drive shaft that engages the inner shuttles and the shaft or attachment point that is connected to the drive mechanism. This allows for the change of rotational axis due to the bend in the housing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE INVENTION

Figure 1A:
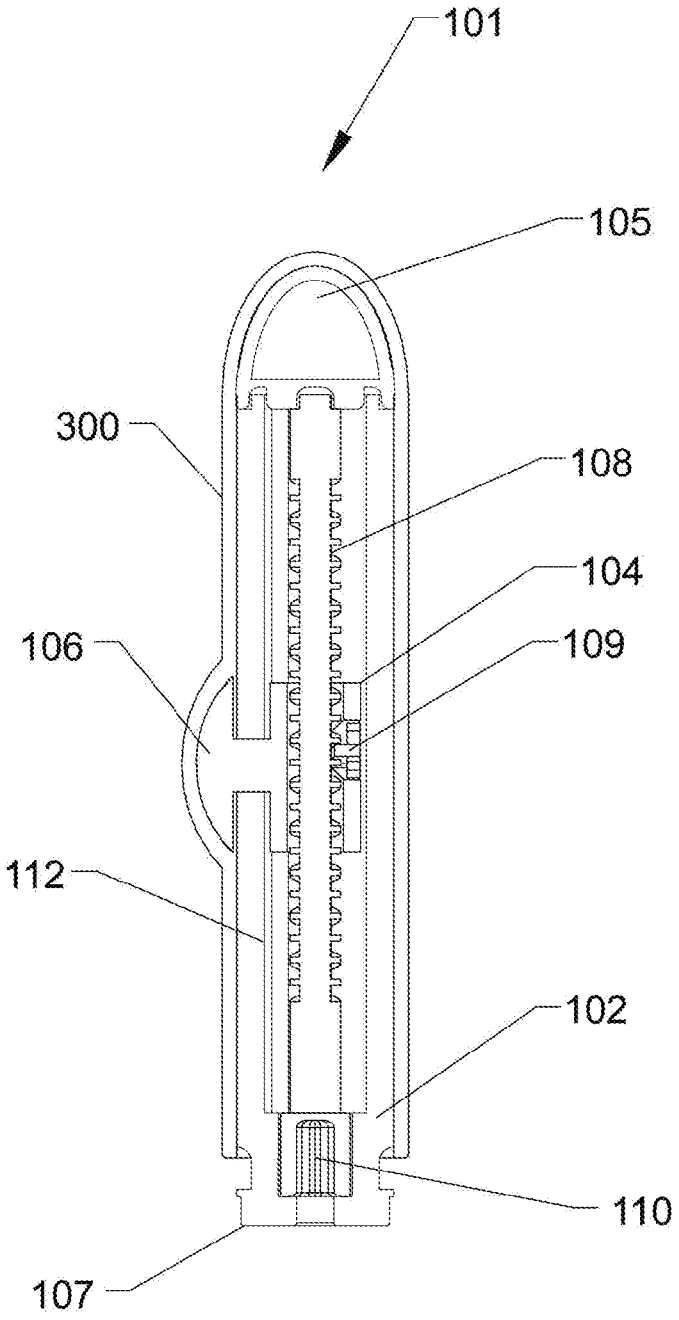
FIG. 1A is a front, cross-sectional view of a mechanical assembly for a dilating device according to an embodiment of the invention.

The present invention is directed to a massage, dilating, and penetrating device (hereinafter referred to as the "dilating device") that is easy to use, incorporates a variety of different size and motion options in a single device, and improves various pelvic and sexual dysfunction conditions. The dilating device provides a variety of functions to the user, including massage, dilation, penetration and assistance with pelvic floor exercise, pressure and trigger point activation, and sexual stimulation, as discussed more fully below. Further, the dilating device may be used in a multitude of medication indications related to pelvic floor disorders. The dilating device may also be used to target the musculature of the pelvic floor for stimulation, massage, and/or dilation, for example the muscular groups of the levator ani and/or coccyges. Generally, the dilating device may be used to address specific disorders including, but not limited to, painful intercourse, general vaginal pain, vaginismus, dyspareunia, high tone pelvic floor dysfunction, vestibulodynia, vagina atrophy, vaginal agenesis, vulvar dermatosis, port radiation adhesions, pudendal neuralgia, and levator ani syndrome. Along with these uses, the design and function may prove useful in real time feed back for users performing Kegel exercises.

The dilating device 100 of the invention is generally formed of a mechanical assembly 101 (or in other embodiments, mechanical assembly 201, mechanical assembly 301, mechanical assembly 401, mechanical assembly 501, or mechanical assembly 601) and a control and drive assembly 103. The mechanical assembly 101 is what makes contact with the user to achieve the desired functions set forth above, while the control/drive assembly 103 is what controls the mechanical assembly 101. In one embodiment, the mechanical assembly 101 and control/drive assembly 103 are formed integrally as one unitary device. In another embodiment, the mechanical assembly 101 may be detachably coupled to the control/drive assembly 103 such that the mechanical assembly 101 may be swapped out for other devices. Each of these components is set forth in detail below.

Figure 1B:
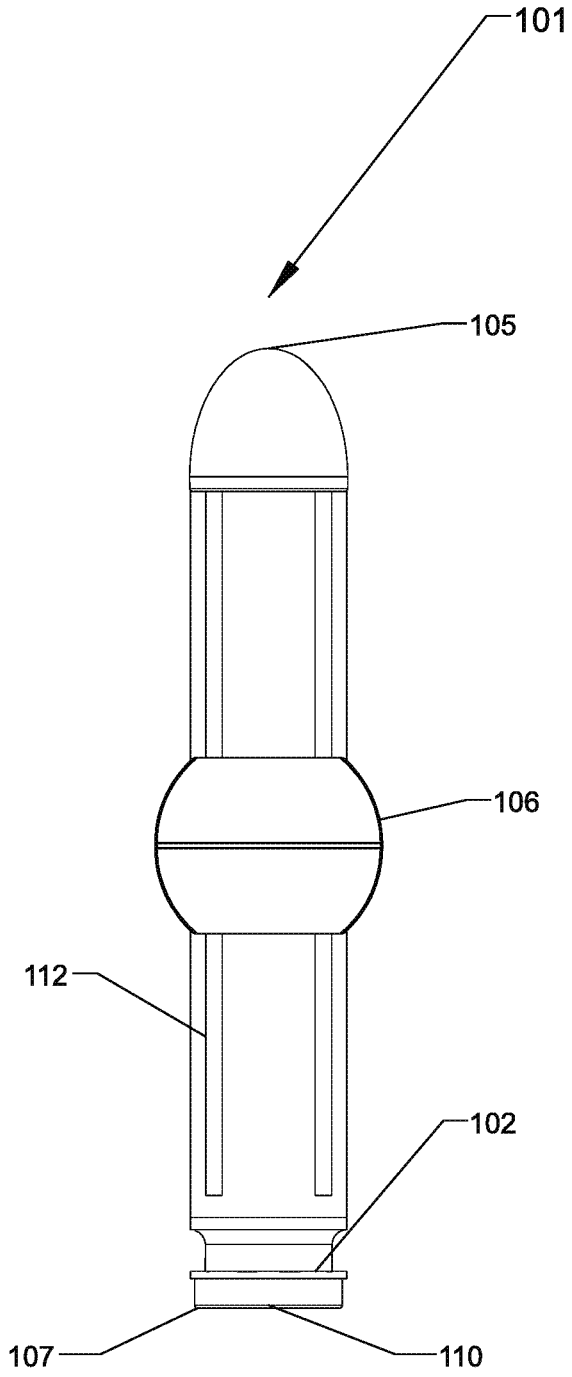
FIG. 1B is the front, plan view of the mechanical assembly of FIG. 1A.

As illustrated in FIGS. 1A-1B, the dilating device 100 has a mechanical assembly 101 that is generally formed of a housing 102, one or more inner shuttles 104, one or more outer shuttles 106, a slotted/recessed thread self-reversing drive shaft, also known as a diamond pattern drive shaft 108, and a motor drive shaft connection point 110. The housing 102 is preferably a rigid housing having a generally cylindrical shape with a tapered nose 105 at one end and a flat surface 107 at the other end. In one embodiment, the housing 102 is formed of a rigid, plastic material. In one embodiment, the housing 102 may be formed of, for example, acrylonitrile butadiene styrene (ABS), polylactic acid (PLA)-based polymers, and nylon, as well as any other polymer-based materials known in the art to have sufficient strength and chemical resistance such that the device is durable and easily cleaned. With this design, the rigid structure of the housing 102 gives the user the ability to focus on specific points of pressure for both therapeutic and stimulation purposes.

The housing 102 generally functions to provide an enclosure for the inner shuttles 104 and the drive shaft 108. The housing 102 also provides a guide track for the inner shuttles 104 to travel as it is moved by the drive shaft 108, as discussed more fully below. This allows each of the inner shuttles 104 to move in alternating directions along a length of the housing. The housing 102 also provides a support structure for an external flexible membrane (such as outer covering 300 illustrated in FIG. 3), as well as a mounting point for any vibrating motor that may be optionally attached.

The inner shuttles 104 have a generally cylindrical shape with an opening to accommodate a pawl or leader 109. The pawl 109 extends through the inner shuttles' opening to engage the slotted or recessed thread drive shaft while also engaging the inner shuttles. In this way, each of the inner shuttles 104 moves in alternating directions inside of the housing 102 and along the length of the housing 102 as the drive shaft 108 rotates, thus initiating the desired effect. The inner shuttles 104 are preferably positioned circumferentially around the drive shaft 108 so that it mates sufficiently therewith.

The drive shaft 108 is preferably in the form of self-reversing or diamond screw design. As illustrated in FIGS. 1A-G, the drive shaft 108 has an elongated circular or rod shape with threads or slots formed in a recessed diamond pattern cut into the surface thereof. As discussed more fully below, the drive shaft 108 engages a drive motor at a motor/drive shaft connection point 110, such that the drive motor rotates the drive shaft 108 about an axis to achieve the effect below. In another embodiment, the drive shaft 108 may have multiple separate threaded sections (not shown) to accommodate multiple inner and outer shuttle combinations of independent movement from one another in the same mechanical assembly 101.

The outer shuttles 106 have a generally circular, semi-circular or elliptical shape. As illustrated in FIG. 1B, the outer shuttles 106 have a generally circular shape that extends circumferentially around the housing 102. The outer shuttles 106 are coupled to the inner shuttles 104 through guide slots 112 on the housing 102. In one embodiment, the inner shuttles 104 and outer shuttles 106 are formed integrally with one another. In another embodiment, the inner shuttles 104 and outer shuttles 106 are separate parts that are removably coupled together using any known attachment mechanisms, such as screws. The coupling of the inner shuttles 104 and outer shuttles 106 (whether integral with each other or removably coupled) causes two effects. First, when the housing 102 has a generally circular shape, the outer shuttles 106 acts to counter the rotation of the inner shuttle 104 when the drive shaft 108 rotates. Second, since the inner shuttle 104 travels along a length of the drive shaft 108 inside the housing 102 when the drive shaft 108 is rotated, the outer shuttles 106 moves along the exterior surface of the housing 102 along the guide slots 112. It is this motion of the outer shuttles 106 that provides the desired effect, whether it is massage or dilation.

Figure 1C:
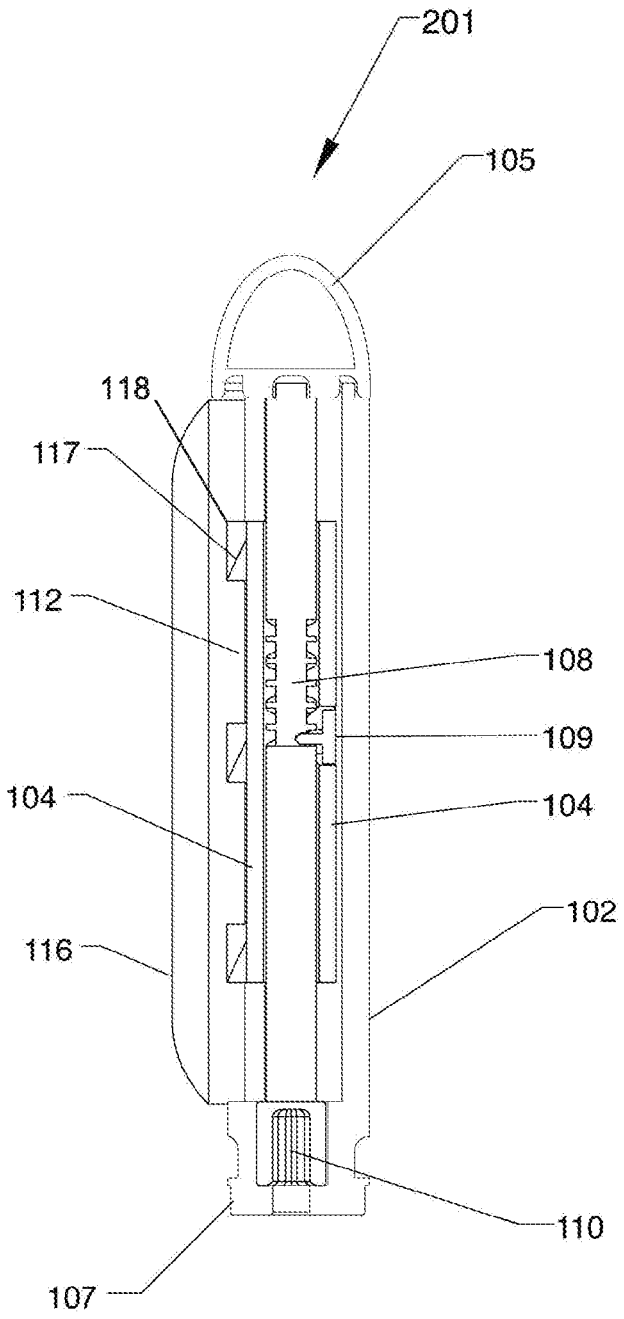
FIG. 1C is a side, cross-sectional view of a mechanical assembly for a dilating device according to an embodiment of the invention.
Figure 1D:
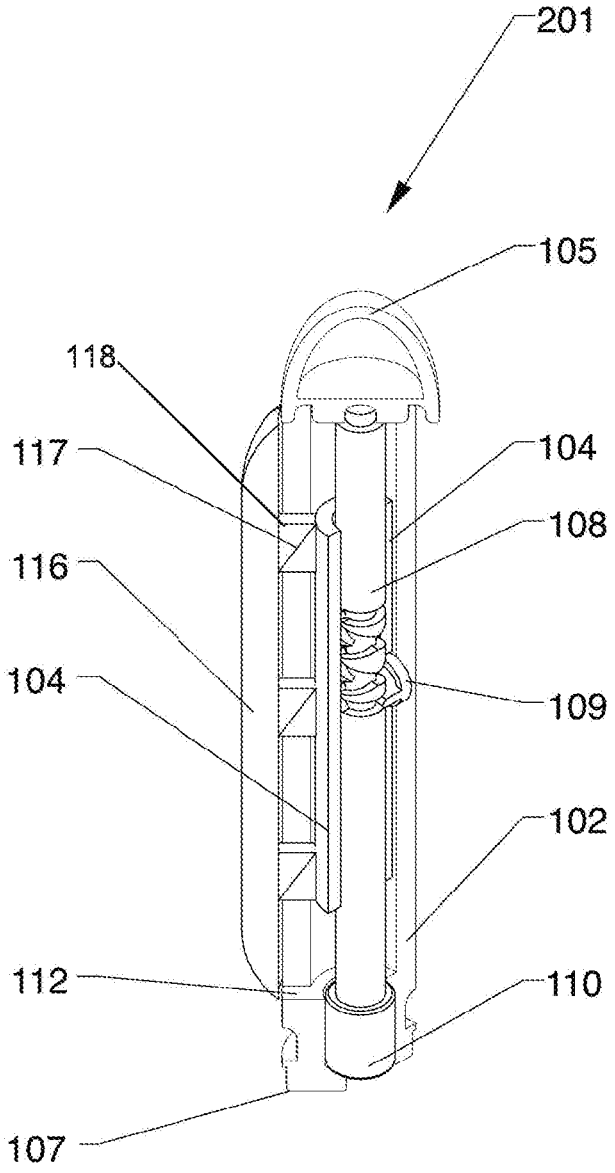
FIG. 1D is an isometric, cross-sectional view of the mechanical assembly of FIG. 1C in a contracted state.
Figure 1E:
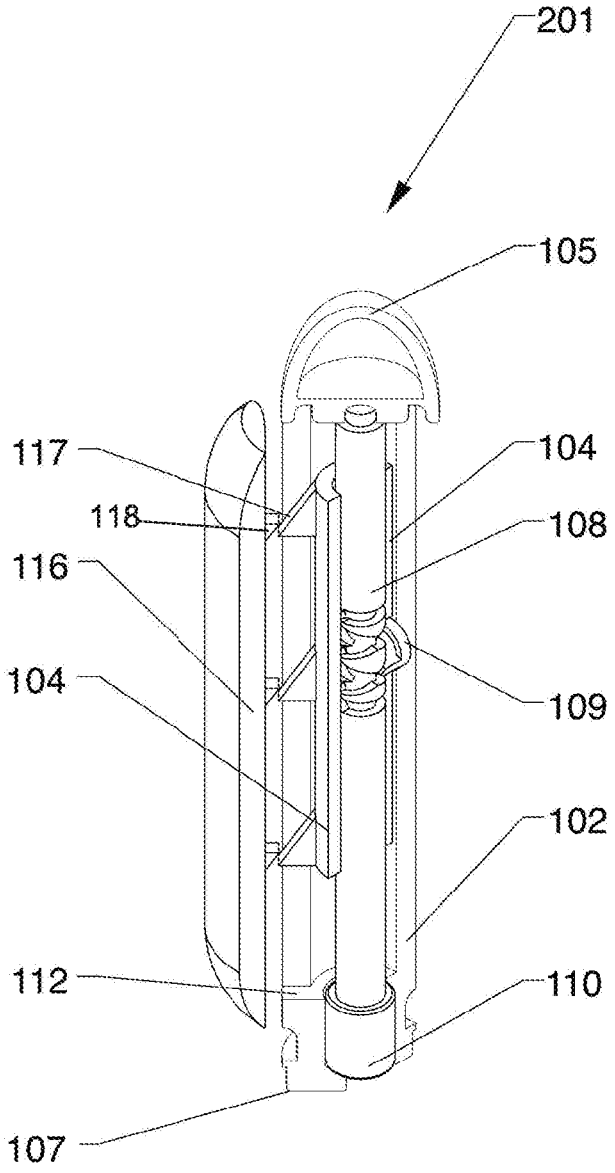
FIG. 1E is an isometric, cross-sectional view of the mechanical assembly of FIG. 1C in an expanded state.

In an embodiment shown in FIGS. 1C-1E, a mechanical assembly 201 uses intermediate moveable surfaces 116 instead of outer shuttles 106. The remainder of the components of the mechanical assembly 201 may be the same as those discussed above with respect to mechanical assembly 101. The inner shuttles 104 act upon one or more intermediate moveable surfaces 116 via interfacing surfaces 117 to cause outward movement of the intermediate moveable surfaces 116, but the inner shuttles 104 are not coupled to the intermediate moveable surfaces 116. As shown in FIGS. 1D and 1E, as the inner shuttles 104 travel along a length of the drive shaft 108 inside the housing 102 when the drive shaft 108 is rotated, the intermediate moveable surfaces 116 move away from the exterior surface of the housing 102 through the guide slots 112. The outward movement of intermediate moveable surface 116 is caused by the ramped shape of interfacing surface 117 pushing against a corresponding ramped shape feature 118 on intermediate moveable surface 116 as the inner shuttle 104 moves upward. As the inner shuttles 104 reverse directions and the inner shuttles 104 move along a length of the drive shaft 108, the intermediate moveable surfaces 116 move toward the exterior surface of the housing. It is this motion of the intermediate moveable surfaces 116 that provides the desired effect, whether it is massage or dilation.

Figure 1F:
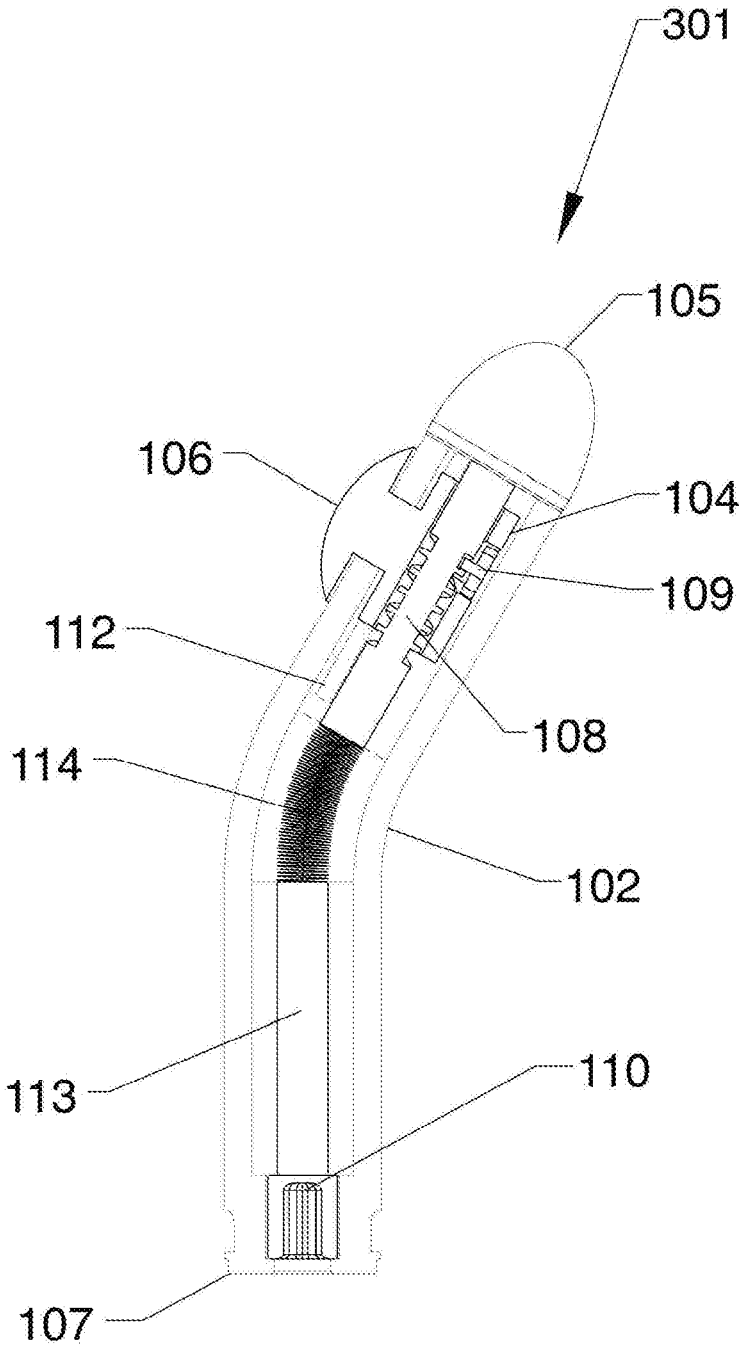
FIG. 1F is a side, cross-sectional view of a mechanical assembly for a dilating device according to an embodiment of the invention.
Figure 1G:
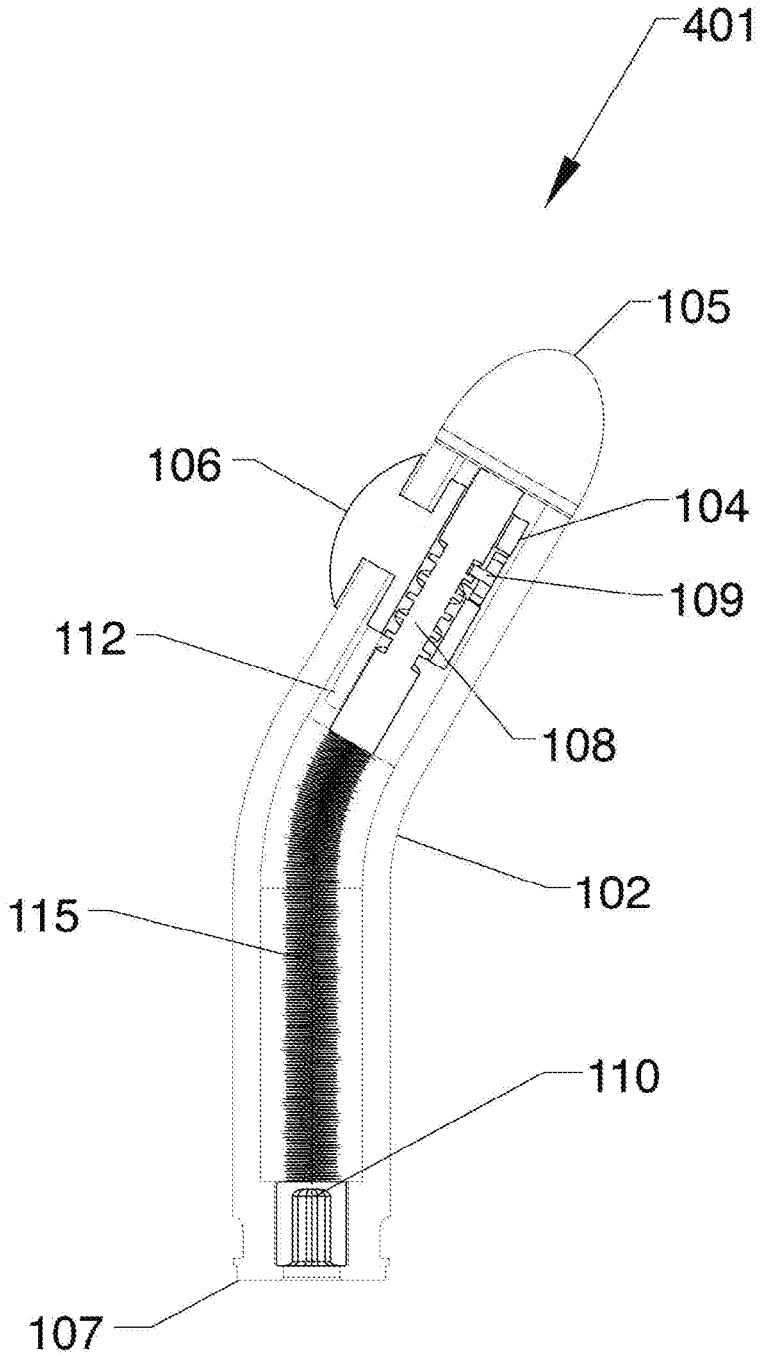
FIG. 1G is a side, cross-sectional view of a mechanical assembly for a dilating device according to an embodiment of the invention.

In the embodiments shown in FIGS. 1F and 1G, mechanical assembly 301 and mechanical assembly 401 are shown. The remainder of the components of the mechanical assembly 301, 401 may be the same as those discussed above with respect to mechanical assembly 101. With mechanical assembly 301, 401, the housing 102 is bent at various angles away from the axis of the motor drive shaft connection point 110. As shown in FIG. 1E, the inclusion of a flexible coupling 114, such as a spring or universal joint, connected to the drive shaft 108 and to a rigid shaft 113 terminating at the motor drive shaft connection point 110 allows the change of rotational axis caused by the bend. In another embodiment, as shown in FIG. 1G, the inclusion of a flexible drive shaft 115, connected to the drive shaft 108 and terminating at the motor drive shaft connection point 110, allows the change of rotational axis caused by the bend.

Figure 1H:
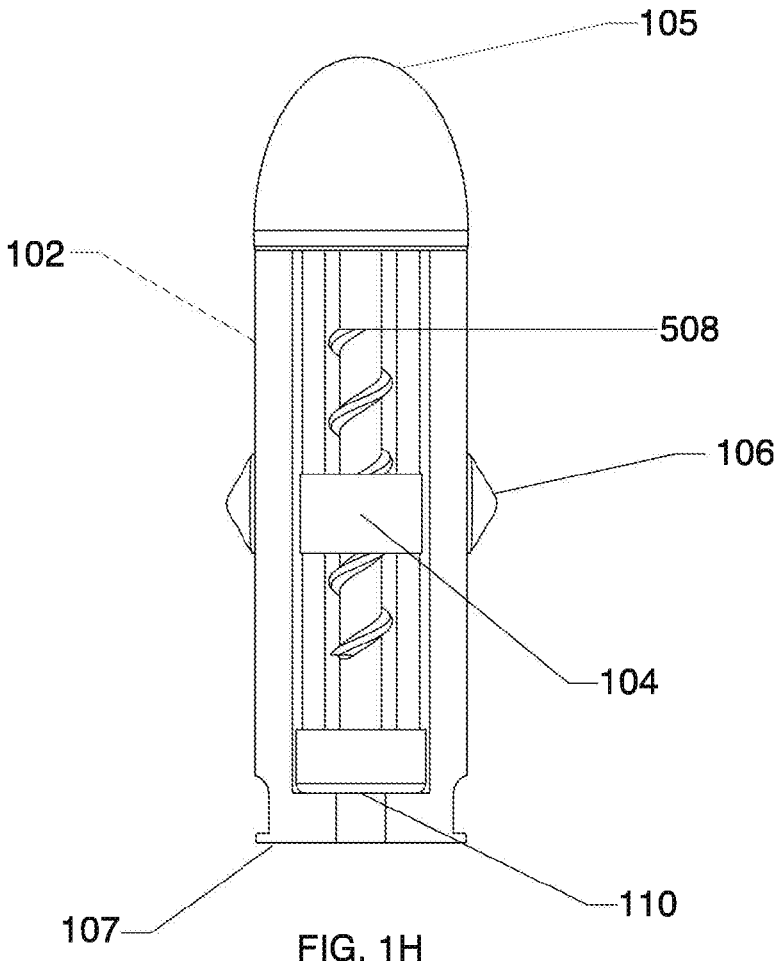
FIG. 1H is a front, cross-sectional view of a mechanical assembly for a dilating device according to an embodiment of the invention.
Figure 1I:
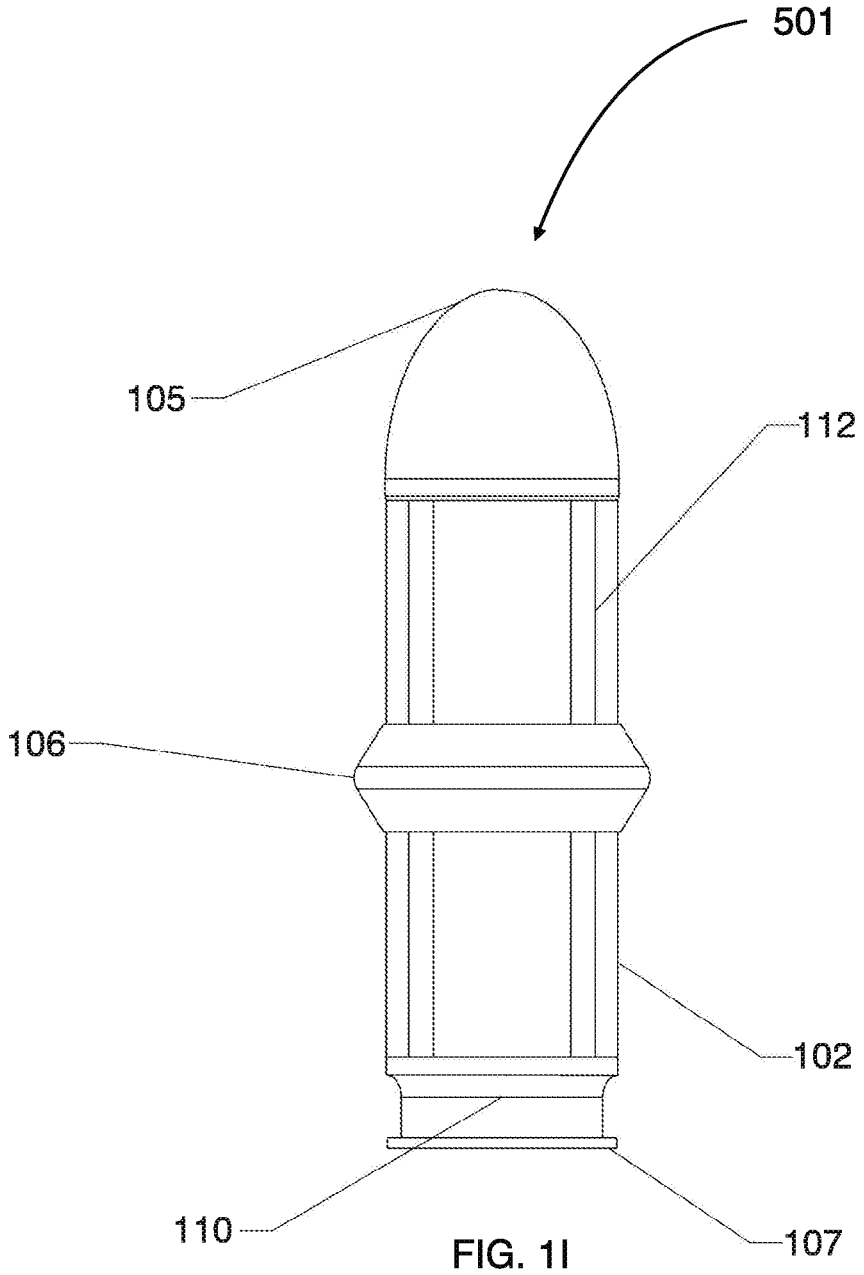
FIG. 1I is the front, plan view of the mechanical assembly of FIG. 1H.

In the embodiment of FIGS. 1H and 1I, a mechanical assembly 501 includes a threaded drive shaft 508. The threaded drive shaft 508 is preferably in the form of a jack screw or leader screw design instead of the self-reversing or diamond screw design of threaded drive shaft 108. The remainder of the components of the mechanical assembly 501 may be the same as those discussed above with respect to mechanical assembly 101.

Figure 2:
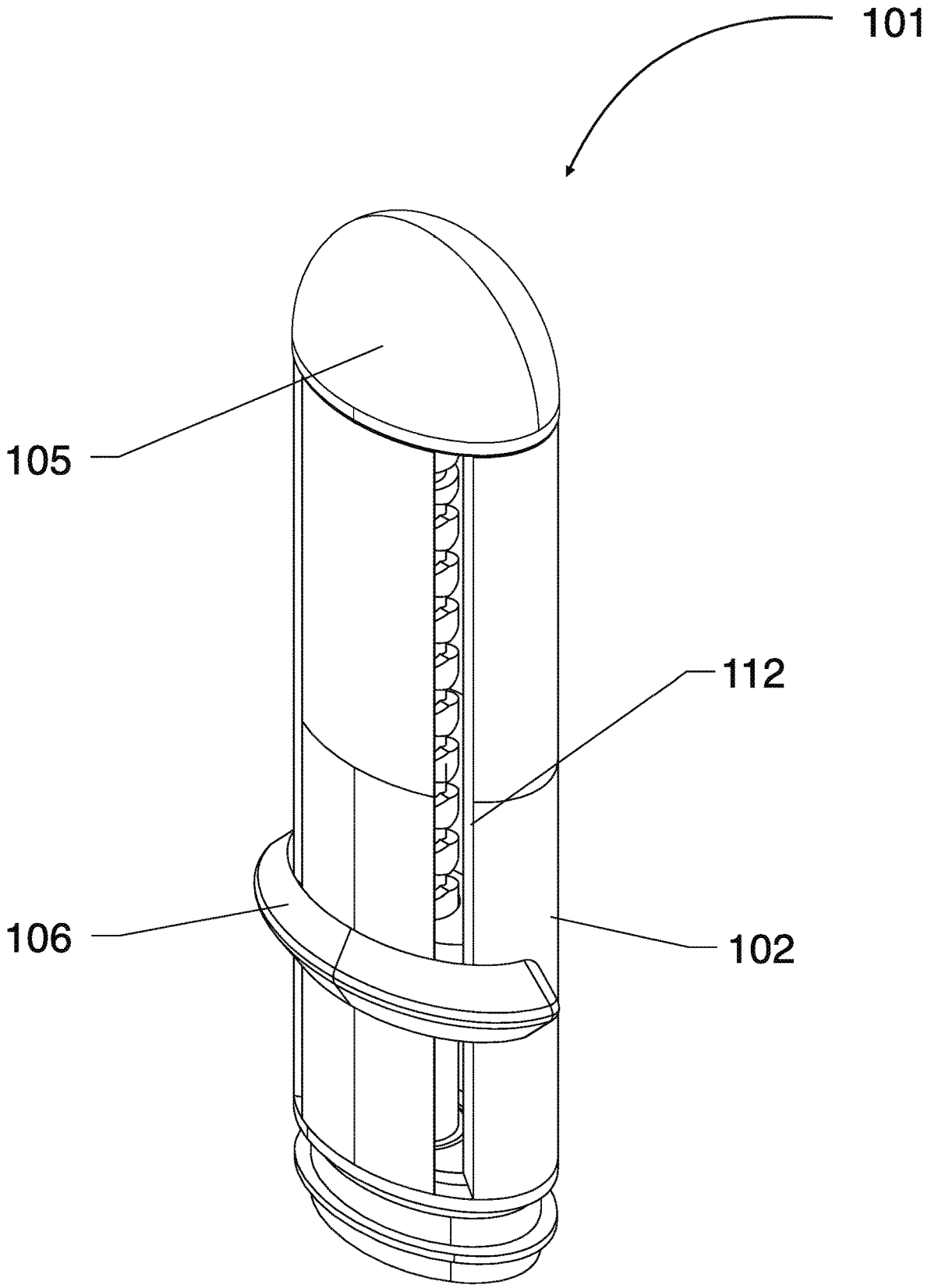
FIG. 2 is an isometric plan view of a mechanical assembly for a dilating device according to an embodiment of the invention.

In an alternative embodiment, as illustrated in FIG. 2, a mechanical assembly 601 has a housing 202 with a cross-sectional elliptical shape, instead of the cross-sectional circular shape as shown in FIGS. 1A-F. The remainder of the components of the mechanical assembly 601 may be the same as those discussed above with respect to mechanical assembly 101, 201, 301, 401 (if drive shaft 108 is used) or mechanical assembly 501 (if drive shaft 508 is used).

Figure 3:
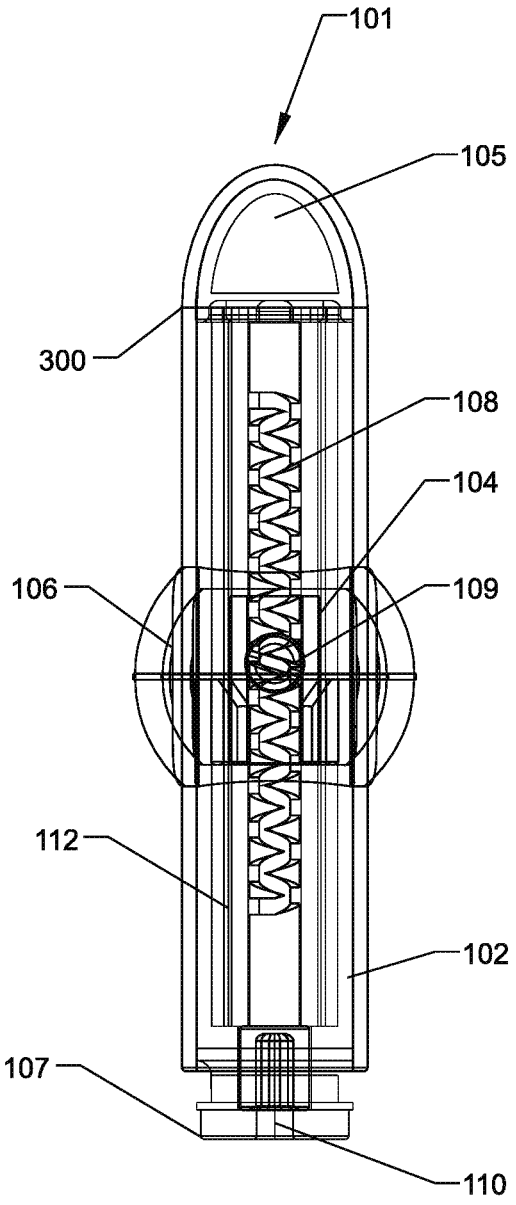
FIG. 3 is a front, cross-sectional view of a mechanical assembly of a dilating device having a flexible, outer covering according to an embodiment of the invention.

As illustrated in FIG. 3, in one embodiment the dilating device 100 further includes a flexible outer covering 300 that houses and protects the housing 102 and the outer shuttles 106. Although FIG. 3 shows outer covering 300 on mechanical assembly 101, outer covering 300 could be used with mechanical assembly 201, 301, 401, 501, and 601. The outer covering 300 also functions to protect the user from the moving mechanism and to protect the mechanism parts, including the inner shuttles 104, outer shuttles 106, and drive shaft 108, from foreign matter intrusion. The outer covering 300 also provides a smooth interface between the user and the dilating device 100 for a more comfortable experience. Since the outer covering 300 is placed around the outer shuttles 106, it also functions to keep the outer shuttles 106 tightly engaged to the rest of the dilating device 100. In the embodiment shown in FIG. 1C-E, the outer covering 300 also acts as a resistant elastic force that returns the intermediate moveable surfaces 116 to their original position through the guide slots 112 toward the exterior surface of the housing 102.

Figure 4A:
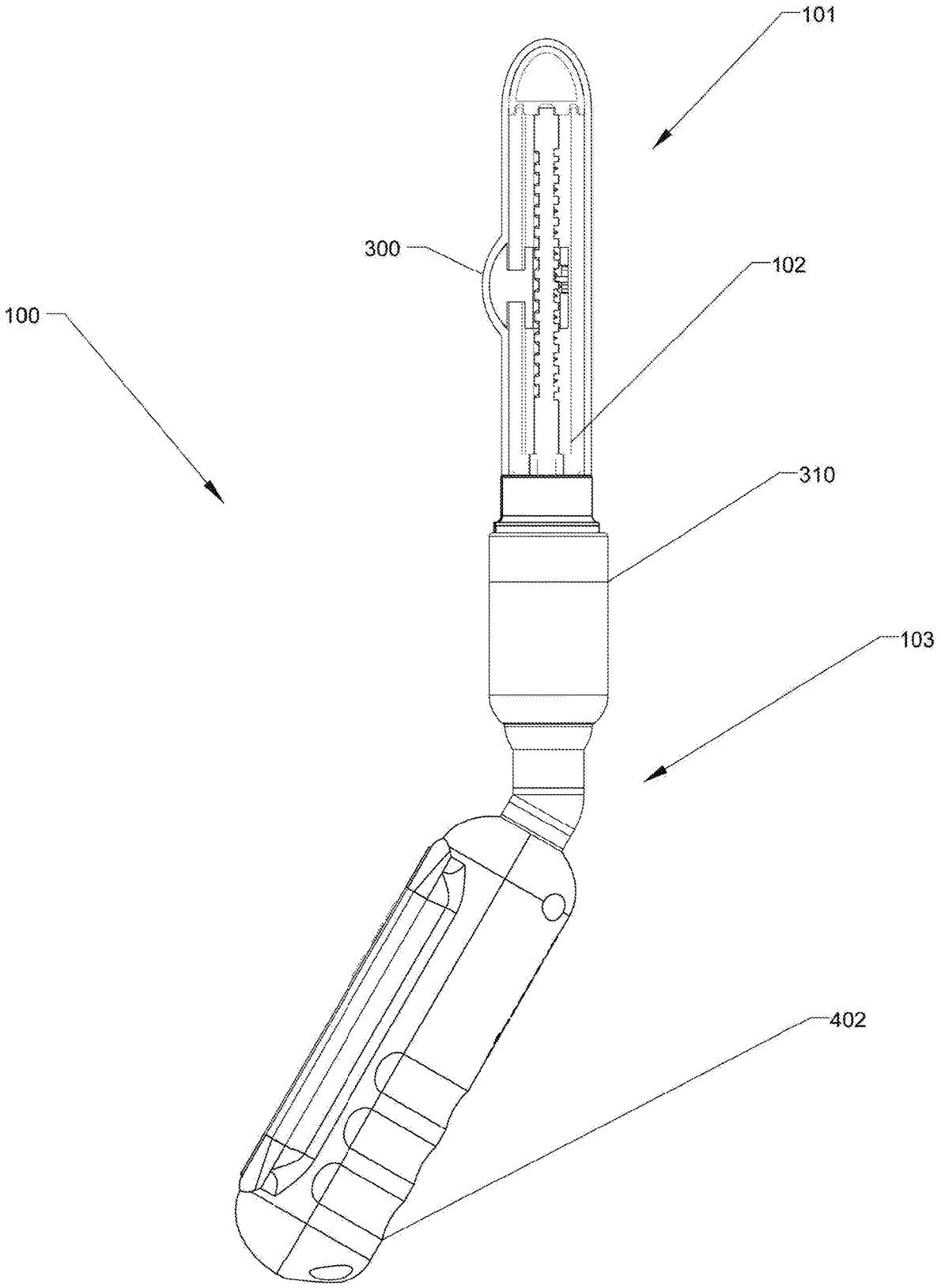
FIG. 4A is a side view of a dilating device according to an embodiment of the invention.

In one embodiment, as illustrated in FIG. 4A, the mechanical assembly 101 is formed integrally with a control/drive assembly 103 as one unitary piece. In this way, the housing 102 of the mechanical assembly 101 is formed as one piece with the outer structure of the control/drive assembly 103. Although FIG. 4A shows mechanical assembly 101, mechanical assembly 201, 301, 401, 501, and 601 can be formed integrally with the control/drive assembly 103.

Figure 4B:
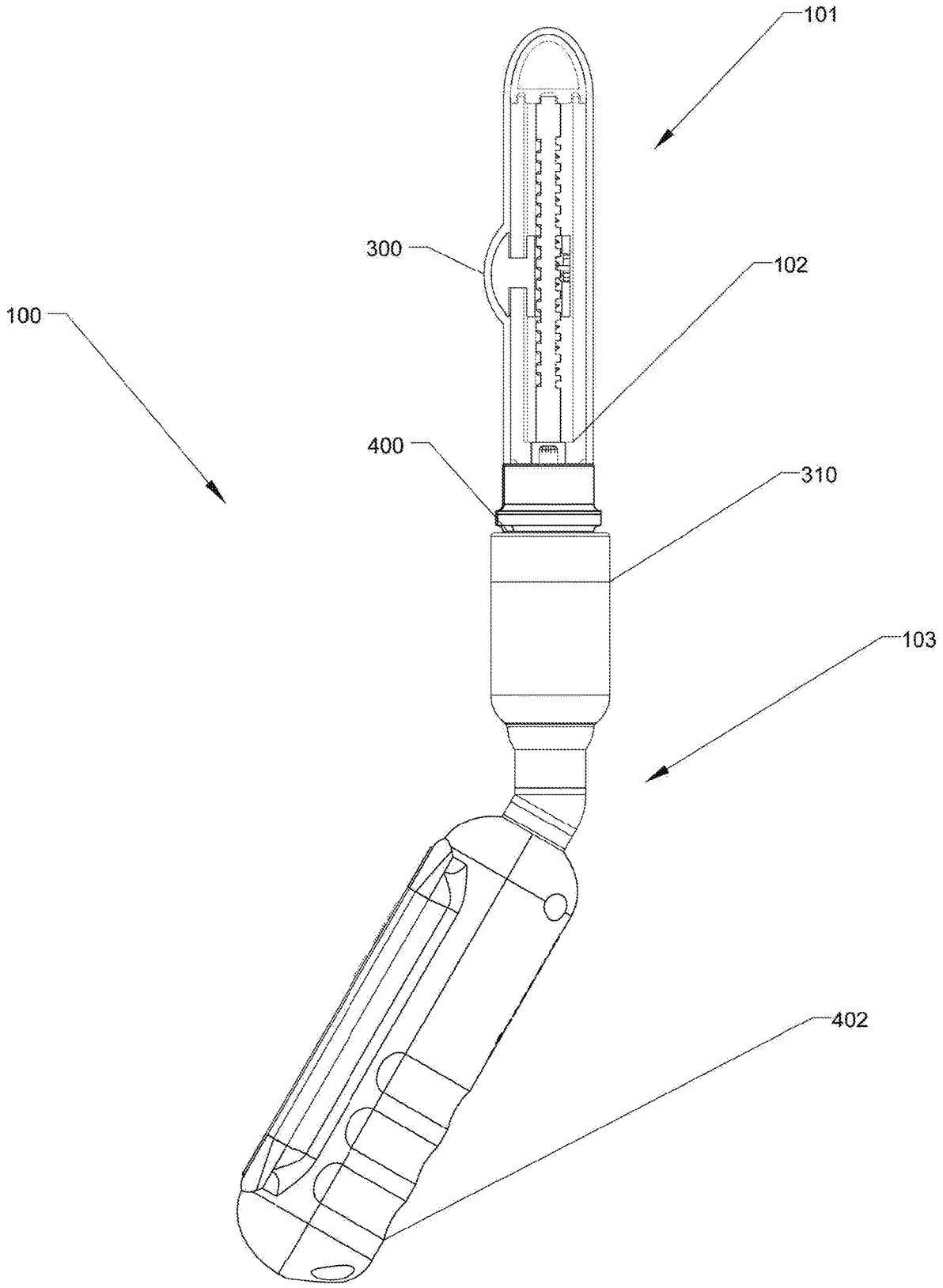
FIG. 4B is a side view of a dilating device according to an embodiment of the invention.

In another embodiment illustrated in FIG. 4B, the mechanical assembly 101 is removably coupled to the control/drive assembly 103 via a modular connector 400, such that the mechanical assembly 101 may be removed and swapped out for other assemblies or devices. The modular connector 400 allows for the interchangeability of different types of mechanical assemblies 101 (such as mechanical assembly 201, 301, 401, 501, and 601) and associated attachments (not shown). This also allows for a variety of sizes and options to be swapped out, depending on the needs of the user, and to replace the mechanical assembly 101 as it degrades due to wear or is damaged. The modular connector 400 serves as a physical securing point for the mechanical assembly 101 or other attachments and it serves as an interface point between the mechanical assembly 101 or other attachments and the control/drive assembly 103, as well as any electrical contacts there between. Either embodiment illustrated in FIGS. 4A-B may include some or all of the electronic components discussed below. Although FIG. 4B shows modular connector 400 used with mechanical assembly 101, modular connector 400 could be used with mechanical assembly 201, 301, 401, 501, and 601.

The dilating device 100 preferably comprises a drive motor 310. The drive motor 310 may be powered by alternating or direct current, and is used to produce the rotating motion that is transferred to the drive shaft 108, 508. In one embodiment, the drive motor 310 may be housed within the modular connector 400. In another embodiment, the drive motor 310 may be housed in a control handle 402 coupled to the modular connector 400 via a flexible drive cable. In yet another embodiment, the drive motor 310 is positioned in and directly connected to the drive shaft 108, 508. A power supply (not shown) of either alternating or direct current may be used, such as dry cell batteries, rechargeable batteries with or without a charging system, or by direct connection to a wall current receptacle.

The dilating device 100 may further comprise an optional vibrating motor (not shown). The vibrating motor may also be powered by alternative or direct current, and it may have a varying level of vibrating effect (e.g., lower vibrating effect for therapy, higher vibrating effect for sexual stimulation). The vibrating motor also uses a low G-force range for therapeutic effect. The vibrating motor may be positioned anywhere along the length of the housing 102, 202 under the outer covering 300. In one embodiment, the vibrating motor may be encapsulated in a molded extension of the outer covering 300.

The dilating device 100 may further include a motor position encoder 404 to measure the rotational cycles of the motor(s). This is beneficial because the motor position encoder could relay the rotational cycle data to a digital control processor (not shown). The exact position of the inner shuttles 104, pawl 109, and/or outer shuttles 106 along the length of the housing 102, based upon calculations using a predetermined algorithm, can be used to precisely control the motion of the inner and outer shuttles 104, 106, thus adjusting the dilating device 100 effect as needed. The motor position encoder 404 preferably has an encoder wheel that is attached to the drive shaft 408 of the motor(s) and is electrically connected to the digital processor board to relay the timing and rotation signal data.

In one embodiment, a force feedback loop may be integrated into the control/drive assembly 103. The control and drive assembly 103 may be designed such that the current draw of the drive motor will be measured during its use. Using baseline nominal free run draw of the drive motor, the digital control processor measures the differences in amperage draw during use. Predetermined and programmed thresholds may trigger device events for safety and therapy purposes, such as shutting off the device 100. The digital control processor may also be used to record the changes in amperage draw during sessions for plotting therapeutic progress or changes.

Figure 4C:
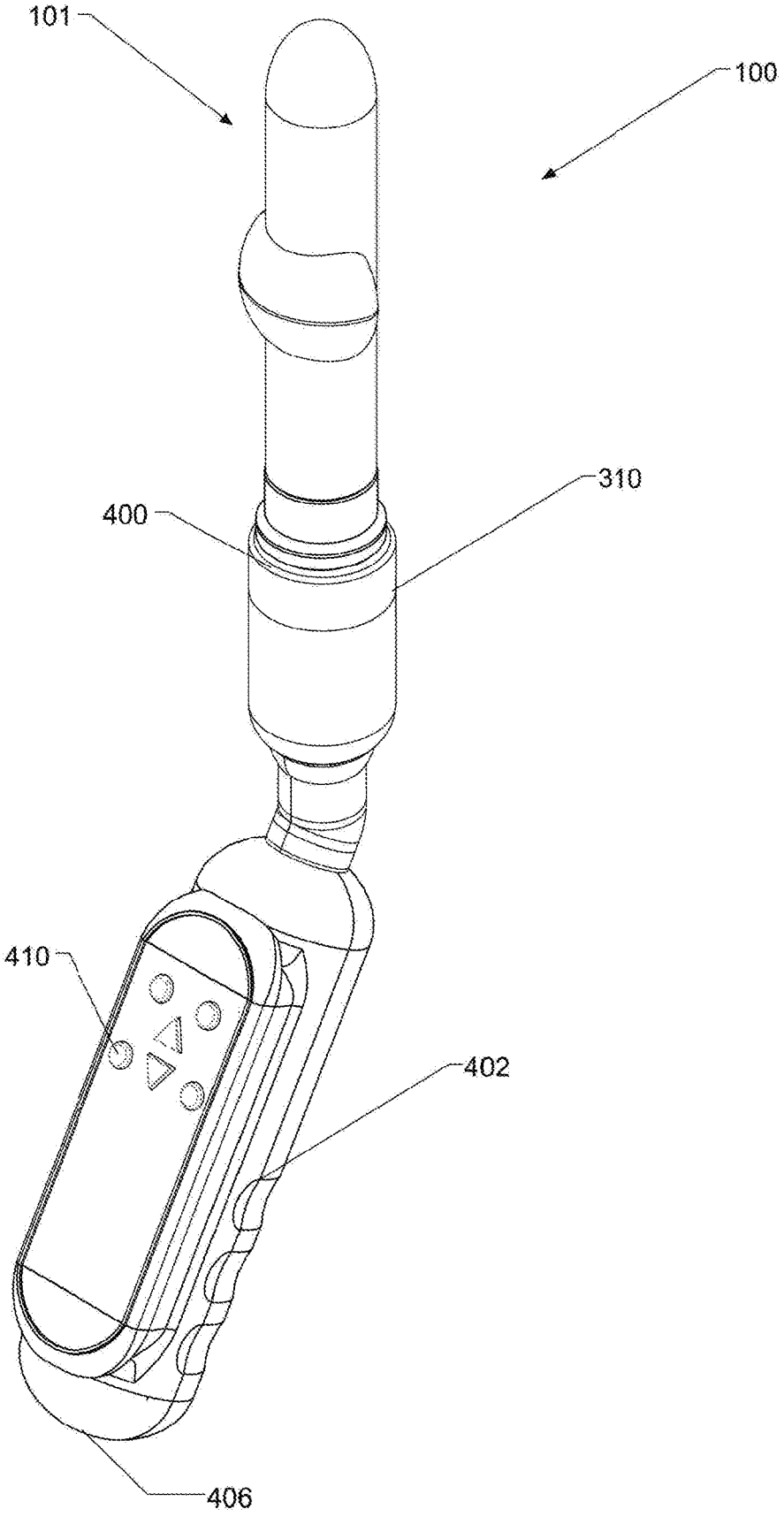
FIG. 4C is a side, perspective view of the device of FIG. 4B.
Figure 4D:
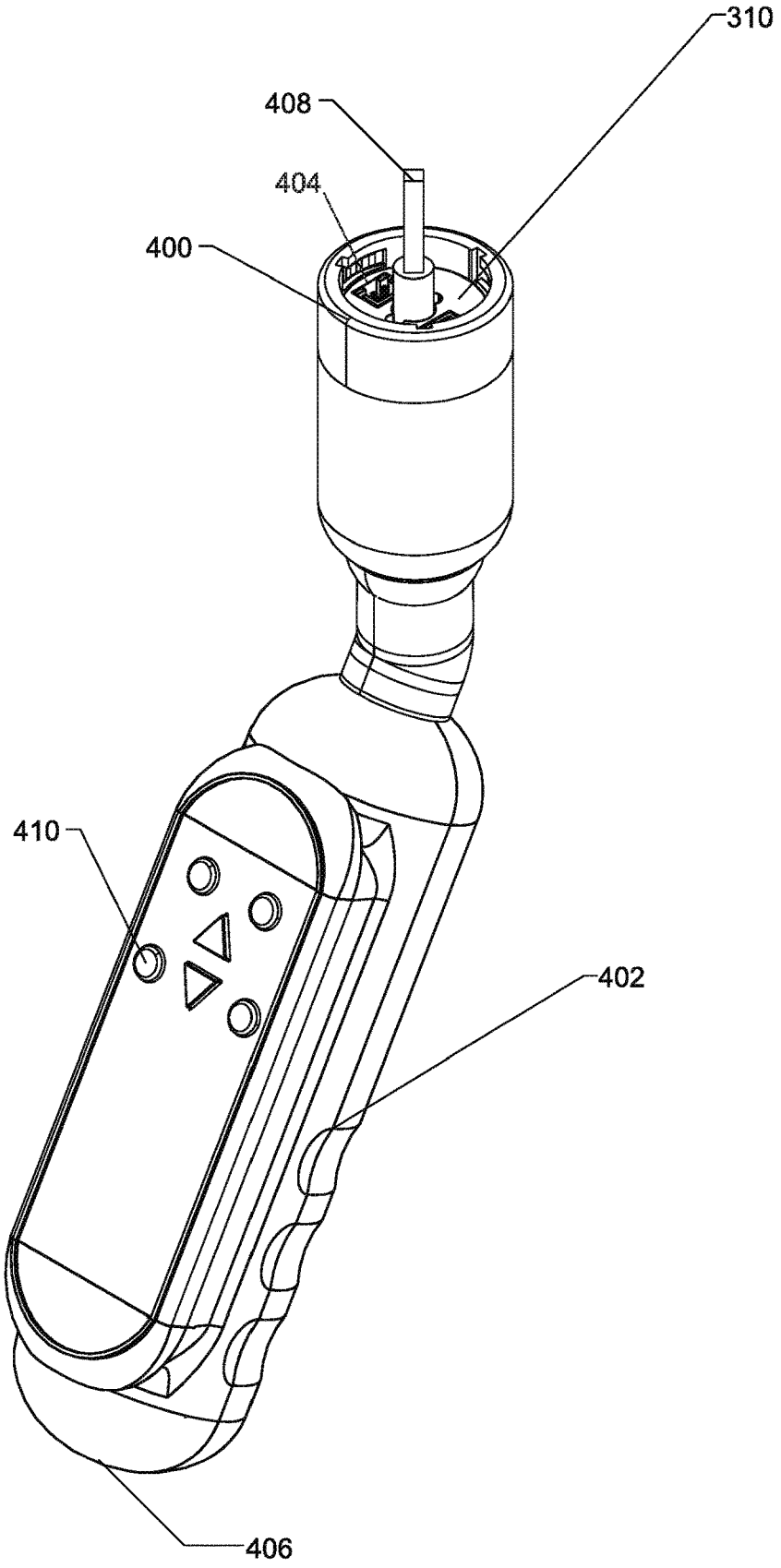
FIG. 4D is a side, perspective view of the device of FIG. 4C, with the mechanical assembly removed.

As illustrated in FIGS. 4C-D, the mechanical assembly 101, drive motor, and the optional vibrating motor may be controlled by a digital or analog control system (not shown). The control system preferably includes a tactile button interface 410 designed into the control handle 402 to transmit user requests (i.e., by sending electrical signals) to the control/drive assembly 103, and thus to the mechanical assembly 101, to achieve a desired result. Although FIGS. 4C and 4D show control handle 402 and interface 410 with mechanical assembly 101, control handle 402 and interface 410 could be used with mechanical assembly 201, 301, 401, 501, and 601.

In the embodiments illustrated in FIGS. 4A-D, the control handle 402 preferably has an ergonomic shape and provides a comfortable user interface to position and operate the device 100. The handle 402 may house the power supply, control systems, such as the tactile button interface 410, and in some embodiments, the drive motor. In another embodiment, a data port 406 such as a mini-USB or similar port, may be designed into control handle 402 for the purposes of data transfer, power supply, and/or firmware updates. The invention contemplates that data transfer, power supply, and/or firmware updates could be made using known wireless protocols, such as BLUETOOTH.

The embodiment illustrated in FIG. 4D is the same as illustrated in FIG. 4C, except the mechanical assembly 101 has been removed to show the positioning of the motor drive shaft 408 when the mechanical assembly 101 and control/drive assembly 103 are fully detached.

Figure 5A:
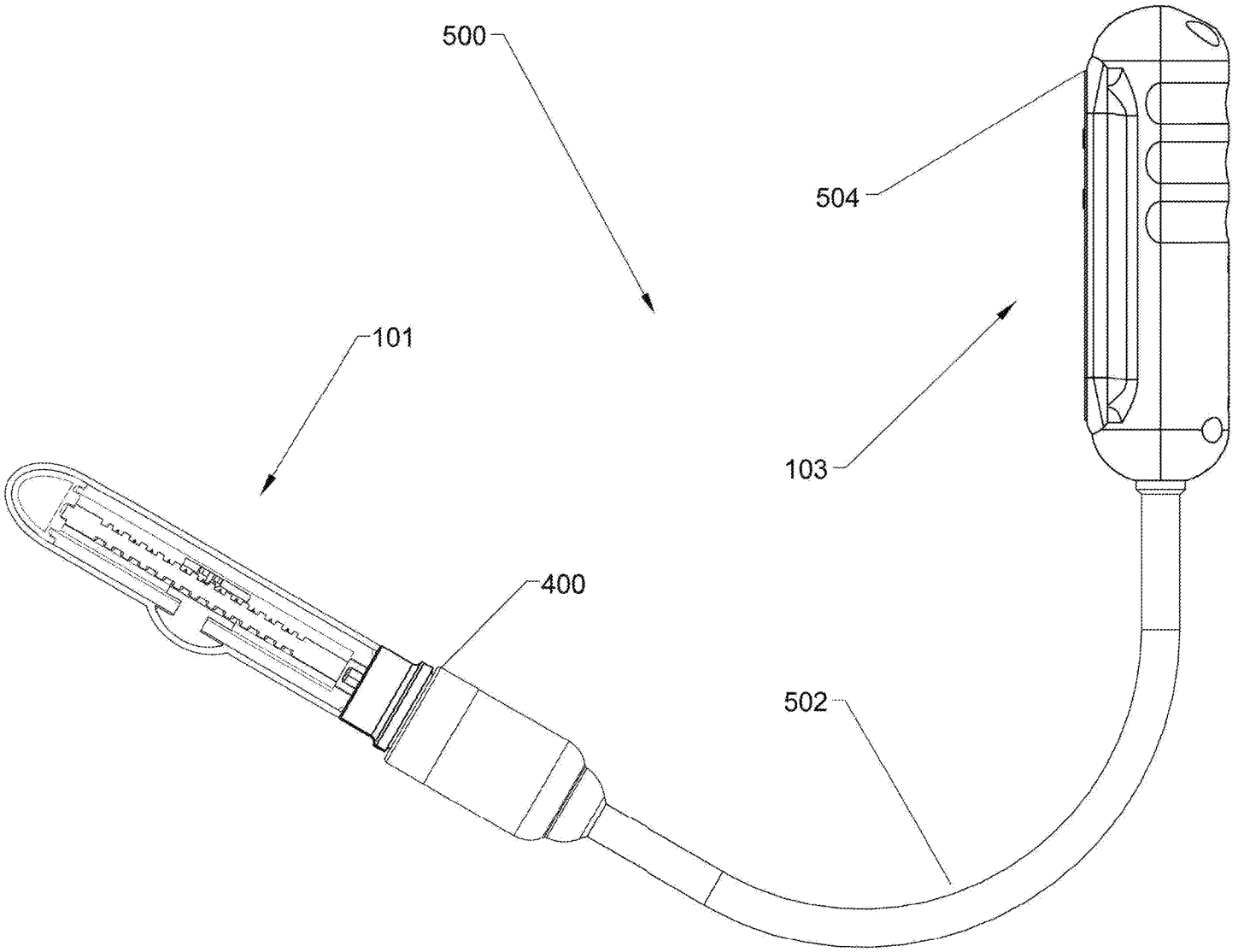
FIG. 5A is a side view of dilating device having a flexible neck according to an embodiment of the invention.
Figure 5B:
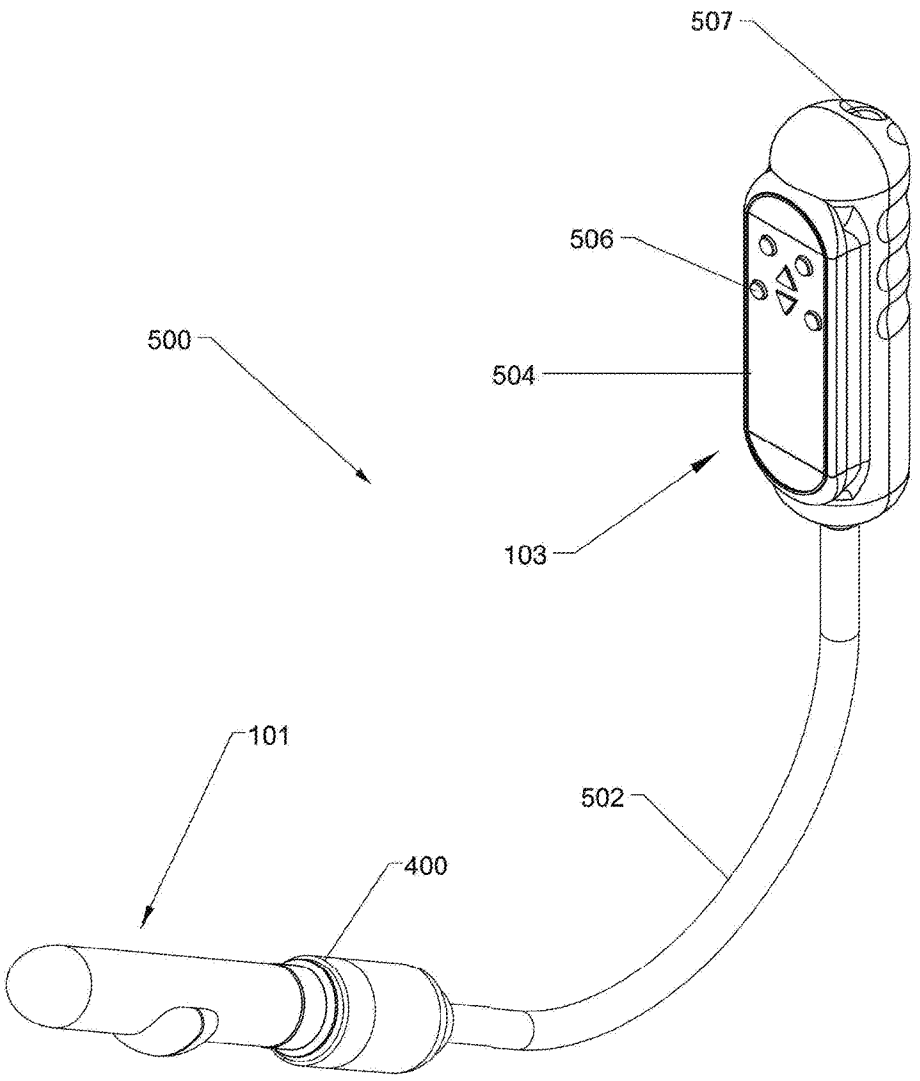
FIG. 5B is a side, perspective view of the dilating device of FIG. 5A.
Figure 5C:
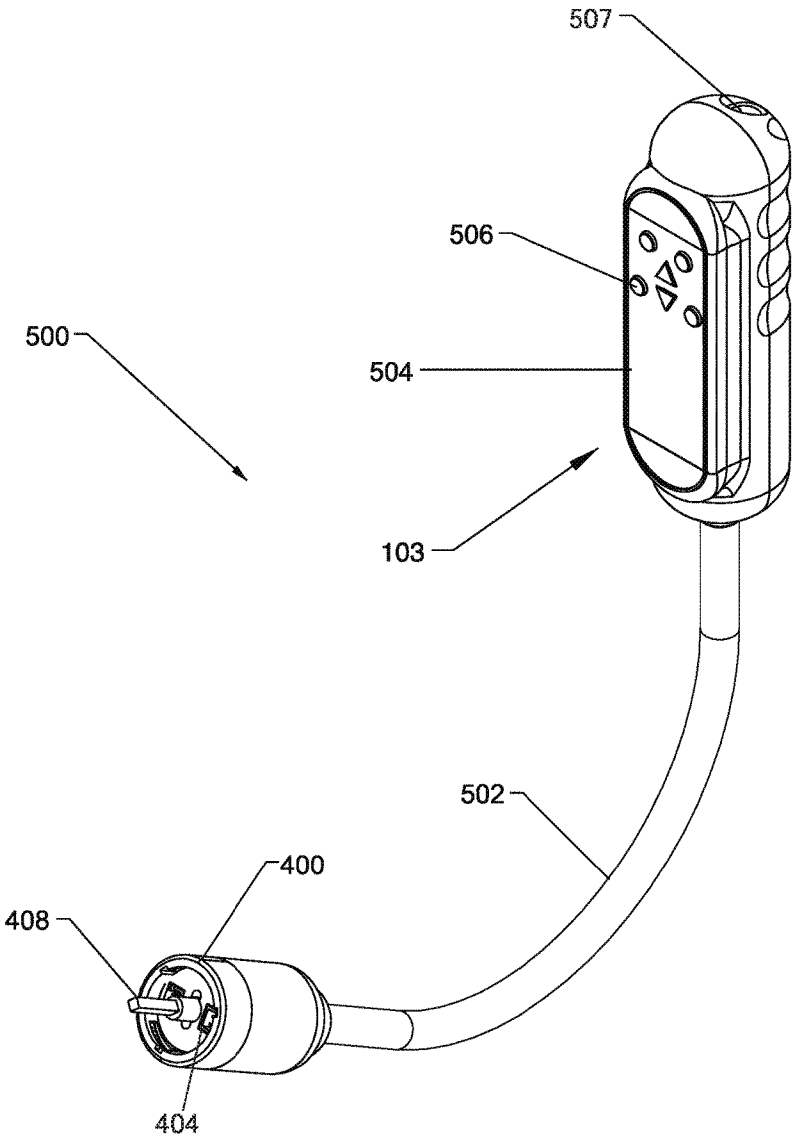
FIG. 5C is a side, perspective view of the dilating device of FIG. 5B, with the mechanical assembly removed.

In another embodiment illustrated in FIGS. 5A-C, a dilating device 500 may include an elongated, flexible neck 502 extending between and connected to the control handle 504 (similar to control handle 402) at one end and the modular connector 400 and/or mechanical assembly 101 at the opposing end that may be used in certain embodiments. The neck 502 may be semi-rigid so as to hold shape profiles determined by the user, but may be generally bent in a U-shape of varying degrees. The neck 502 has sufficient flexibility for the user to shape, but it is also sufficiently rigid to keep its shape when pressure is exerted upon it during use. Sufficient rigidity achieves the correct pressure point application used during therapy sessions, for example. The neck 502 also allows the user to operate the unit while in a reclined and relaxed position, without having to flex or tense muscle areas to reach the desired position. In one embodiment, the neck 502 is preferably hollow to serve as a conduit for electrical wires to send power and/or signals between the control handle 504 and the mechanical assembly 101, flexible drive shafts, etc. The exterior of the conduit may be clad in a flexible, washable material such as silicone or vinyl. Although 5A-C show dilating device 500 with mechanical assembly 101, dilating device 500 could be used with mechanical assembly 201, 301, 401, 501, and 601.

As illustrated in FIG. 5B, the control handle 504 of device 500 may also include a tactile button interface 506 designed into the control handle 504 to transmit user requests (i.e., by sending electrical signals) to the control/drive assembly 103, and thus to the mechanical assembly 101, to achieve a desired result.

In the embodiments illustrated in FIGS. 5A-C, the control handle 504 preferably has an ergonomic shape and provides a comfortable user interface to position and operate the device 100. The handle 504 may house the power supply, control systems, such as the tactile button interface 506, and in some embodiments, the drive motor. In another embodiment, a data port 507 such as a mini-USB or similar port, may be designed into control handle 504 for the purposes of data transfer, power supply, and/or firmware updates. As previously noted, the invention contemplates that data transfer, power supply, and/or firmware updates could be made using known wireless protocols, such as BLUETOOTH.

The embodiment illustrated in FIG. 5C is the same as illustrated in FIG. 5B, except the mechanical assembly 101 has been removed to show the positioning of the motor drive shaft 408 when the mechanical assembly 101 and control/drive assembly 103 with flexible neck 502 are detached.

Although this invention has been described in connection with specific forms and embodiments thereof, it will be appreciated that various modifications other than those discussed above may be resorted to without departing from the spirit or scope. For example, equivalent elements may be substituted for those specifically shown and described, certain features may be used independently of other features, and in certain cases, particular locations of elements may be reversed or interposed, all without departing from the spirit or scope as defined in the appended Claims.

What is claimed:

1. A massage and dilating device, comprising:

a mechanical assembly, including, a hollow, cylindrical housing having a tapered end and a guide slot extending along an outer surface thereof;

an elongated self-reversing or diamond pattern drive shaft positioned inside of the housing and having threads cut into the surface thereof;

an inner shuttle engaging the threads on the drive shaft by way of a movable pawl and positioned inside the housing;

at least one intermediate moveable surface positioned outside of the housing and laterally moveable by vertical movement of the inner shuttle through the guide slot along an interfacing surface; and a control and drive assembly coupled to the mechanical assembly to control operation of the massage and dilating device.

2. The massage and dilating device of claim 1, wherein the housing is formed of a rigid material.

3. The massage and dilating device of claim 1, wherein the housing has an elliptical shape.

4. The massage and dilating device of claim 1, further comprising a drive motor that rotates the drive shaft about an axis.

5. The massage and dilating device of claim 4, wherein the drive motor is positioned within the control and drive assembly, which is coupled to the housing at a flat end opposite the tapered end through a motor/drive shaft connection point.

6. The massage and dilating device of claim 5, wherein the housing has a bend and the elongated self-reversing or diamond pattern drive shaft is coupled to the drive motor by a flexible coupling connected to a rigid drive motor shaft or a flexible drive motor shaft.

7. The massage and dilating device of claim 6, wherein the flexible coupling and rigid drive motor shaft or flexible drive motor shaft change the rotation axis of the self-reversing or diamond pattern drive shaft with respect to the drive motor shaft.

8. The massage and dilating device of claim 1, wherein the inner shuttle has a generally circular shape and is positioned circumferentially around the drive shaft.

9. The massage and dilating device of claim 1, wherein the inner shuttle moves in alternating directions along an inside of the housing as the drive shaft rotates.

10. The massage and dilating device of claim 1, further comprising a flexible, outer covering encapsulating the housing.

11. The massage and dilating device of claim 1, wherein the housing is removably coupled to the control and drive assembly via a modular connector.

12. The massage and dilating device of claim 11, further comprising a drive motor positioned inside the modular connector.

13. The massage and dilating device of claim 12, further comprising a vibrating motor.

14. The massage and dilating device of claim 13, wherein the vibrating motor is encapsulated by a flexible outer covering.

15. The massage and dilating device of claim 1, further comprising a data port for data transfer, power supply, or firmware updates.

16. The massage and dilating device of claim 1, wherein the control and drive assembly includes a control handle and an elongated, flexible neck extending between and connecting the control handle to the mechanical assembly.

17. The massage and dilating device of claim 16, wherein the elongated, flexible neck functions as a conduit for electrical wires to send signals between the control handle and the mechanical assembly.

18. The massage and dilating device of claim 16, further comprising a modular connector connected to the mechanical assembly at one end and the flexible neck at an opposing end, the modular connector housing at least a drive motor.

* * * * *